US011209190B2

(12) United States Patent
Wu

(10) Patent No.: US 11,209,190 B2
(45) Date of Patent: Dec. 28, 2021

(54) HYBRID HEAT PUMP SYSTEM

(71) Applicant: City University of Hong Kong, Kowloon (HK)

(72) Inventor: Wei Wu, Kowloon (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/440,194

(22) Filed: Jun. 13, 2019

(65) Prior Publication Data

US 2020/0393167 A1 Dec. 17, 2020

(51) Int. Cl.

| | |
|---|---|
| ***F25B 1/08*** | (2006.01) |
| ***F25B 49/02*** | (2006.01) |
| ***F25B 7/00*** | (2006.01) |
| ***F25B 6/04*** | (2006.01) |
| *F25B 49/04* | (2006.01) |

(52) U.S. Cl.

CPC ..... *F25B 1/08* (2013.01); *F25B 6/04* (2013.01); *F25B 7/00* (2013.01); *F25B 49/02* (2013.01); *F25B 49/04* (2013.01)

(58) Field of Classification Search

CPC ..... F25B 1/08; F25B 7/00; F25B 6/04; F25B 49/02; F25B 49/04; F25B 27/007; F25B 15/008; F25B 25/02

See application file for complete search history.

(56) References Cited

U.S. PATENT DOCUMENTS

| | | | | |
|---|---|---|---|---|
| 4,031,712 | A * | 6/1977 | Costello | F25B 1/00 62/483 |
| 2006/0090502 | A1* | 5/2006 | Taras | F24F 3/153 62/510 |
| 2007/0019708 | A1* | 1/2007 | Shiflett | C09K 5/047 374/181 |
| 2010/0223939 | A1* | 9/2010 | Mitra | F25B 1/10 62/117 |
| 2011/0107790 | A1* | 5/2011 | Dunn | F04B 39/06 62/507 |

(Continued)

FOREIGN PATENT DOCUMENTS

| | | | | |
|---|---|---|---|---|
| JP | 2003328973 | A * | 11/2003 | |
| JP | 2007278686 | A * | 10/2007 | |
| WO | WO-2015051537 | A1 * | 4/2015 | F25B 49/02 |

*Primary Examiner* — Emmanuel E Duke

(74) *Attorney, Agent, or Firm* — Renner Kenner Greive Bobak Taylor & Weber

(57) ABSTRACT

A hybrid heat pump system including first compression means operable to form a refrigerant vapor and increases the pressure of the refrigerant vapor; condensing means to receive pressurized vapor and condense the vapor to a liquid; pressure reduction means through which the liquid refrigerant passes to reduce the pressure of the liquid to form a mixture of liquid and vapor refrigerant; evaporator means to receive the mixture of liquid and vapor refrigerant to evaporate the remaining liquid; second compression means including first and second inlet ports and an outlet port to receive a portion of the refrigerant vapor from the evaporator means and the pressurized vapor from the first compression means; increase the pressure thereof; and pass the pressurized vapor to the condensing means through the outlet port; and a conduit to pass a portion of the refrigerant vapor leaving the first compression means to the second compression means.

14 Claims, 8 Drawing Sheets

(56) References Cited

U.S. PATENT DOCUMENTS

| | | | | |
|---|---|---|---|---|
| 2011/0162396 | A1* | 7/2011 | Chen | F25B 9/008 62/115 |
| 2019/0128273 | A1* | 5/2019 | Goldenberg | F04D 29/056 |
| 2019/0285317 | A1* | 9/2019 | Shi | F25B 1/10 |

* cited by examiner

HYBRID HEAT PUMP SYSTEM

FIELD OF INVENTION

The present invention relates to a hybrid heat pump system, and more particularly, to a hybrid absorption-compression heat pump system with refrigerant injection for use in cooling and heating.

BACKGROUND

Heat pump cycles are widely used for cooling, heating, and drying in a range of sectors, including residential, commercial and industrial applications. Conventional heat pump cycles include electrically-driven vapor-compression cycle and thermally-driven absorption cycle.

The vapor-compression cycle features high cooling efficiency, high cooling-to-heating capacity ratio (heat pump tends to be oversized in cooling mode) and high extraction-to-rejection heat ratio (soil temperature decreases for ground-source applications), while the absorption cycle shows opposite features, i.e., high heating efficiency, high heating-to-cooling capacity ratio (heat pump tends to be oversized in heating mode) and high rejection-to-extraction heat ratio (soil temperature increases for ground-source applications).

SUMMARY OF INVENTION

In accordance with a first aspect of the present invention, there is provided a hybrid heat pump system comprising:

- first compression means operable to form a refrigerant in vapor form and increases the pressure of the refrigerant vapor;
- condensing means arranged to receive the pressurized vapor and condense the vapor under pressure to a liquid;
- pressure reduction means through which the liquid refrigerant leaving the condensing means passes to reduce the pressure of the liquid to form a mixture of liquid and vapor refrigerant;
- evaporator means arranged to receive the mixture of liquid and vapor refrigerant that passes through the pressure reduction means to evaporate the remaining liquid to form refrigerant vapor;
- second compression means including two, first and second inlet ports and an outlet port and operable to:
  - receive at least a portion of the refrigerant vapor from the evaporator means and the pressurized vapor from the first compression means through the first and second inlet ports respectively;
  - increase the pressure thereof; and pass the pressurized vapor to the condensing means through the outlet port;

and

- a conduit operable to pass a portion of the refrigerant vapor leaving the first compression means to the second compression means.

In an embodiment of the first aspect, the second compression means further includes an injection-type compressor for injecting the pressurized vapor leaving the first compression means to the second compression means.

In an embodiment of the first aspect, the second compression means further includes a two-stage compressor, whereby a portion of the refrigerant vapor from the evaporator means is introduced to the first stage of the second compression means and the pressurized vapor leaving the first compression means is injected between the first stage and the second stage of the second compression means subsequent to the first stage.

In an embodiment of the first aspect, the second compression means further includes two, first and second serially-connected compressors, whereby a portion of the refrigerant vapor from the evaporator means is introduced to the first compressor and the pressurized vapor leaving the first compression means is injected between the first compressor and the second compressor.

In an embodiment of the first aspect, the second compression means further includes a dual-cylinder compressor for each receiving and compressing a portion of the refrigerant vapor from the evaporator means and the pressurized vapor from the first compression means individually and for passing both to the condensing means.

In an embodiment of the first aspect, the second compression means further includes two, first and second parallelly-connected compressors for each receiving and compressing a portion of the refrigerant vapor from the evaporator means and the pressurized vapor from the first compression means individually and for passing both to the condensing means.

In an embodiment of the first aspect, the first compression means further includes:

- an absorber that forms a mixture of a refrigerant and an absorbent; and
- a generator that receives the mixture from the absorber and heats the mixture to separate refrigerant, in vapor form, from the absorbent.

In an embodiment of the first aspect, the pressure of the refrigerant vapor from the generator is increased by the second compression means.

In an embodiment of the first aspect, the pressure at the outlet port is higher than that at the two inlet ports, and the pressure at the second inlet port is higher than that at the first inlet port.

In an embodiment of the first aspect, the pressurized vapor leaving the first compression means and a portion of the vapor leaving the evaporator means are received by the second compression means individually and pressurized by the second compression means and subsequently received and condensed by the condensing means.

In an embodiment of the first aspect, a portion of the vapor leaving the evaporator means is received and pressurized by the second compression means, and the pressurized vapor leaving the first and second compression means are subsequently received and condensed by the condensing means.

In an embodiment of the first aspect, the first compression means is activated and the second compression means is deactivated, whereby the refrigerant vapor leaving the evaporator means is received by the first compression means and subsequently received and condensed by the condensing means.

In an embodiment of the first aspect, the first compression means is deactivated and the second compression means is activated, whereby the refrigerant vapor leaving the evaporator means is received and pressurized by the second compression means and subsequently received and condensed by the condensing means.

In an embodiment of the first aspect, the fluid communication between the first compression means and the condensing means is manipulated by a first valve and the fluid communication between the first and second compression means is manipulated by a second valve.

In an embodiment of the first aspect, the second compression means includes at least one of reciprocating compressor, rolling compressor, scroll compressor, screw compressor, and centrifugal compressor.

BRIEF DESCRIPTION OF DRAWINGS

Embodiments of the present invention will now be described, by way of example, with reference to the accompanying drawings in which.

DETAILED DESCRIPTION

Figure 1:
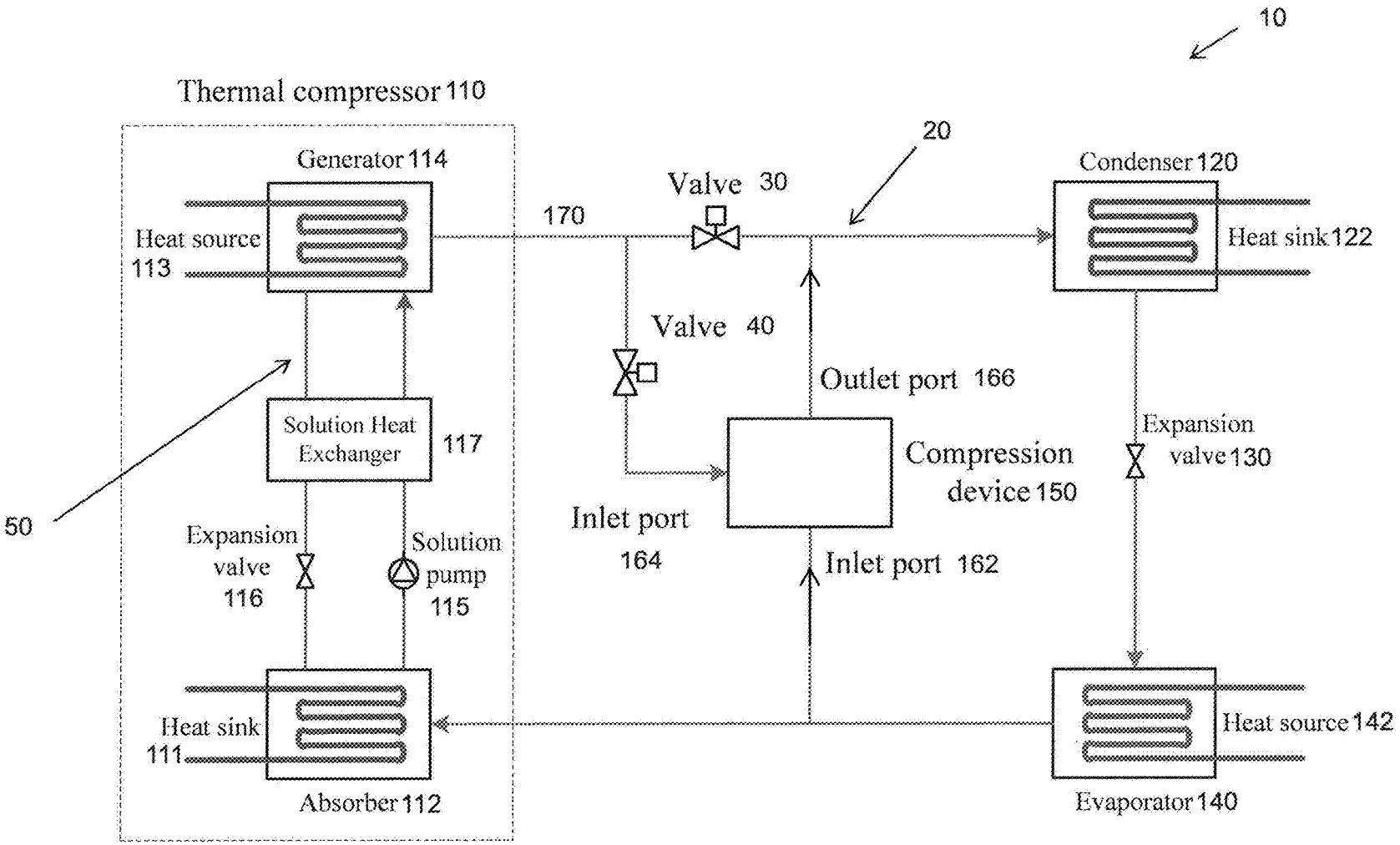
FIG. 1 is a schematic diagram of the hybrid absorption-compression heat pump with refrigerant injection in one embodiment of the invention.

Without wishing to be bound by theories, the inventors, through their own researches, trials and experiments, have devised that the combination of the absorption cycle and the compression cycle can strengthen the advantages and cancel the disadvantages for year-round operations. However, using two cycles will make the system more complex and costlier.

To simplify the system and improve the cost-effectiveness, a hybrid absorption-compression is proposed. The compression sub-cycle and the absorption sub-cycle are installed in parallel and share the condenser, expansion valve and evaporator.

To further improve the performance of the whole cycle, a novel hybrid absorption-compression heat pump with refrigerant injection is invented. A compression device with a mid-pressure inlet port is used for the compression sub-cycle, while the refrigerant generated from the absorption sub-cycle is injected into the mid-pressure port of the compressor instead of flowing into the shared condenser directly. In this manner, the absorption sub-cycle could be driven by lower-temperature heat sources, as well as work under lower evaporating temperatures and higher heat sink temperatures.

The novel heat pump can operate in various modes:

(1) Combined absorption-compression mode. The design proportions of the compression sub-cycle and the absorption sub-cycle can be adjusted by the mid-pressure outlet port to accommodate the supply-side capacity profiles and demand-side load profiles, to maximize primary energy efficiencies, to minimize heat pump oversizing, or to reach annual rejection-and-extraction heat balance.

(2) Single compression mode with the absorption sub-cycle bypassed. This mode can be used when the thermal energy (from solar source, geothermal source, waste source, fossil fuel, etc.) is not available or not preferred, with the system powered by electricity from the grid or by mechanical energy from the fuel engine.

(3) Single absorption mode with the compression sub-cycle bypassed. This mode can be used when the electrical energy or mechanical energy is not available or not preferred.

In addition, the hybrid absorption-compression cycle includes the cycles with and without refrigerant injection. These modes can be operated alternatively depending on the actual situations.

Referring to FIGS. 1 to 8, there is provided a hybrid heat pump system 10 comprising: first compression means 110 operable to form a refrigerant 20 in vapor form and increases the pressure of the refrigerant vapour 20, condensing means 120 arranged to receive the pressurized vapour 20 and condense the vapor 20 under pressure to a liquid 20, pressure reduction means 130 through which the liquid refrigerant 20 leaving the condensing means 120 passes to reduce the pressure of the liquid 20 to form a mixture of liquid and vapor refrigerant 20, evaporator means 140 arranged to receive the mixture of liquid and vapor refrigerant 20 that passes through the pressure reduction means 130 to evaporate the remaining liquid 20 to form refrigerant vapour 20, second compression means 150 including two, first and second inlet ports 162, 164 and an outlet port 166 and operable to receive at least a portion of the refrigerant vapor 20 from the evaporator means 140 and the pressurized vapor 20 from the first compression means 110 through the first and second inlet ports 162, 164 respectively, increase the pressure thereof, and pass the pressurized vapor 20 to the condensing means 120 through the outlet port 166, and a conduit 170 operable to pass a portion of the refrigerant vapor 20 leaving the first compression means 110 to the second compression means 150.

The overall configuration of the hybrid heat pump system 10 is depicted in FIG. 1. Essentially, the hybrid heat pump system 10 includes first compression means 110, condensing means 120, pressure reduction means 130 and evaporator means 140, and second compression means 150 through which a refrigerant 20 is circulated in cycles.

The condensing means 120 is in fluid communication with a heat sink 122 for cooling the refrigerant 20 before entering the pressure reduction means 130. The evaporator means 140 is in fluid communication with a heat source 142 for heating the refrigerant 20 leaving the pressure reduction means 130. There is also provided a conduit 170 operable to pass a portion of the refrigerant vapour 20 leaving the first compression means 110 to the second compression means 150.

The first and second compression means 110 and 150 are connected in parallel configuration with and share the condensing means 120, the pressure reduction means 130 and the evaporator means 140, thereby forming a hybrid vapor compression-absorption cycle with a compression sub-cycle driven by the compression device 150 and an absorption sub-cycle driven by the thermal compressor 110.

Preferably, the first compression means 110 may be a thermal compressor and further includes an absorber 112 for forming a mixture of the refrigerant 20 and a solution 50 i.e. an absorbent. The generator 114 receives the mixture from the absorber 112 and heats the mixture to separate refrigerant 20, in vapor form, from the absorbent 50. The absorber 112 is in fluid communication with a heat sink 111 for cooling the mixture and the generator 114 is in fluid communication with a heat source 113 for heating the mixture respectively. The first compression means 110 further includes a solution pump 115 for increasing the pressure of the mixture and pumping the mixture to the generator 114, and an expansion valve 116 for reducing the pressure of the mixture. There is further provided a solution heat exchanger 117 which transfers some heat from the mixture leaving the generator 114 to the mixture leaving the pump 115. Finally, the mixture leaving the generator 114 is throttled by the expansion valve 116 to the absorber pressure.

Preferably, the second compression means 150 includes two, first and second inlet ports 162 and 164 and an outlet port 166. The second compression means 150 may be in fluid communication with the evaporator means 140 and the generator 114 through the first and second inlet ports 162 and 164 respectively at the upstream and in fluid communication with the condensing means 120 at the downstream. The generator 114 may also be in fluid communication with the condensing means 120 directly. The first inlet port 162 is at a low pressure, the second inlet port 164 is at a medium pressure, and the outlet port 166 is at a high pressure respectively.

The refrigerant 20 from the evaporator 140 divides into two streams, with one flowing into the absorber 112 of the absorption sub-cycle directly and the other flowing into the compression device 150 of the compression sub-cycle through the first inlet port 162.

Advantageously, the refrigerant 20 generated from the absorption sub-cycle flows into the mid-pressure port 164 of the compression device 150 instead of flowing into the shared condenser 120 directly. Under decreased generation pressure (medium pressure versus high pressure), the absorption sub-cycle could be driven by lower-temperature heat sources 113, as well as work under lower evaporating temperatures and higher heat sink temperatures.

The pressure of the refrigerant vapor from the generator 114 is increased by the second compression means 150, thereby decreasing the required generation pressure at the generator 114. The two streams with different pressure levels are received through the first and second inlet ports 162, 164 and subsequently merged in the compression device 150. In particular, the low-pressure refrigerant from the first inlet port 162 is first pressurized to mid-pressure, and then merges with the mid-pressure refrigerant from the second inlet port 164. Then, the mixed refrigerant is pressurized together to high-pressure and discharged at the outlet port 166. The discharge refrigerant 20 leaving the compression device 150 in turn flows into the condenser 120.

There is also provided two, first and second valves 30, 40 for regulating the flow of the refrigerant 20 from the generator 114 to the condenser 120, thereby operating the heat pump system 10 at different modes. The fluid communication between the generator 114 of the first compression means 110 and the condensing means 120 is manipulated by the first valve 30. The fluid communication between the generator 114 of the first compression means 110 and the second inlet port 164 of the second compression means 150 is manipulated by the second valve 40.

The operating mode can be switched depending on the actual operating conditions. By switching valve 30 and valve 40, the novel heat pump can operate at single absorption cycle, single compression cycle, and hybrid absorption-compression cycle. The hybrid absorption-compression cycle includes the cycles with and without refrigerant injection. These modes can be operated alternatively depending on the actual situations.

Figure 5:
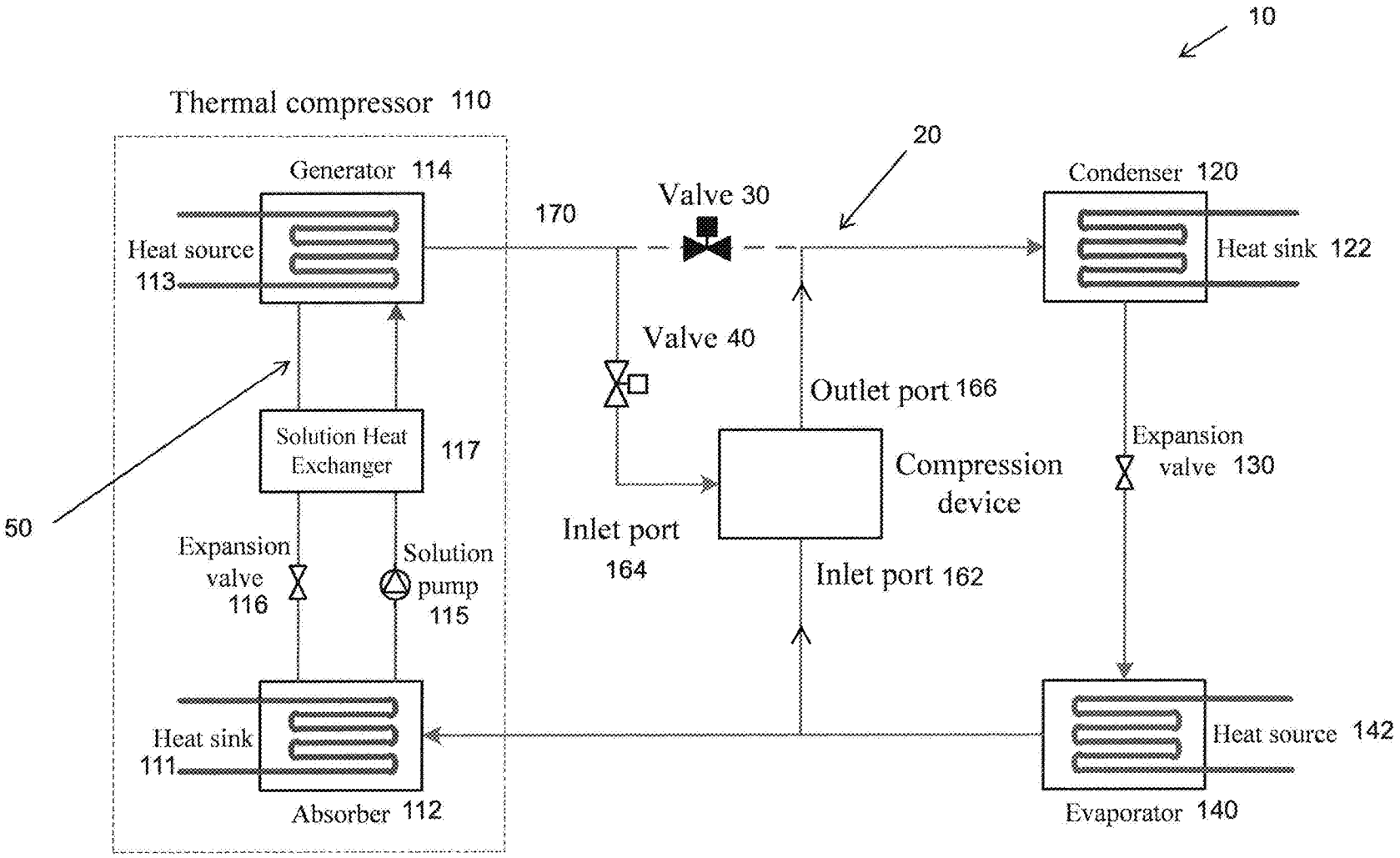
FIG. 5 is a schematic diagram of the hybrid absorption-compression heat pump of FIG. 1 operated in hybrid absorption-compression cycle mode with refrigerant injection.
Figure 6:
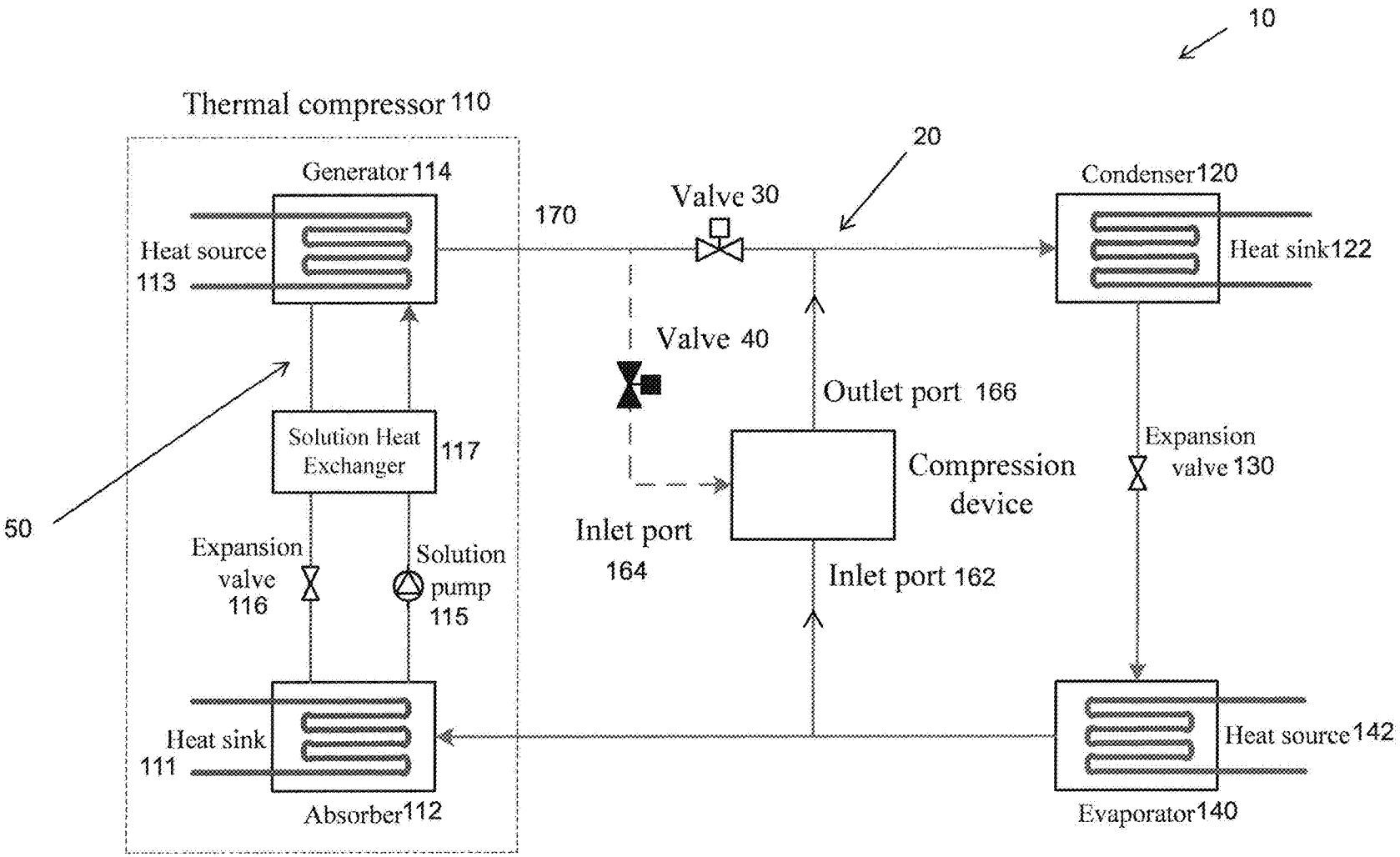
FIG. 6 is a schematic diagram of the hybrid absorption-compression heat pump of FIG. 1 operated in hybrid absorption-compression cycle mode without refrigerant injection.

In particular, mode 1 operates as a hybrid heat pump system 10 with refrigerant injection when the first valve 30 is closed and the second valve 40 is open (as shown in FIG. 5). Mode 2 operates as a hybrid heat pump system 10 without refrigerant injection when the first valve 30 is open and the second valve 40 is closed (as shown in FIG. 6).

Figure 7:
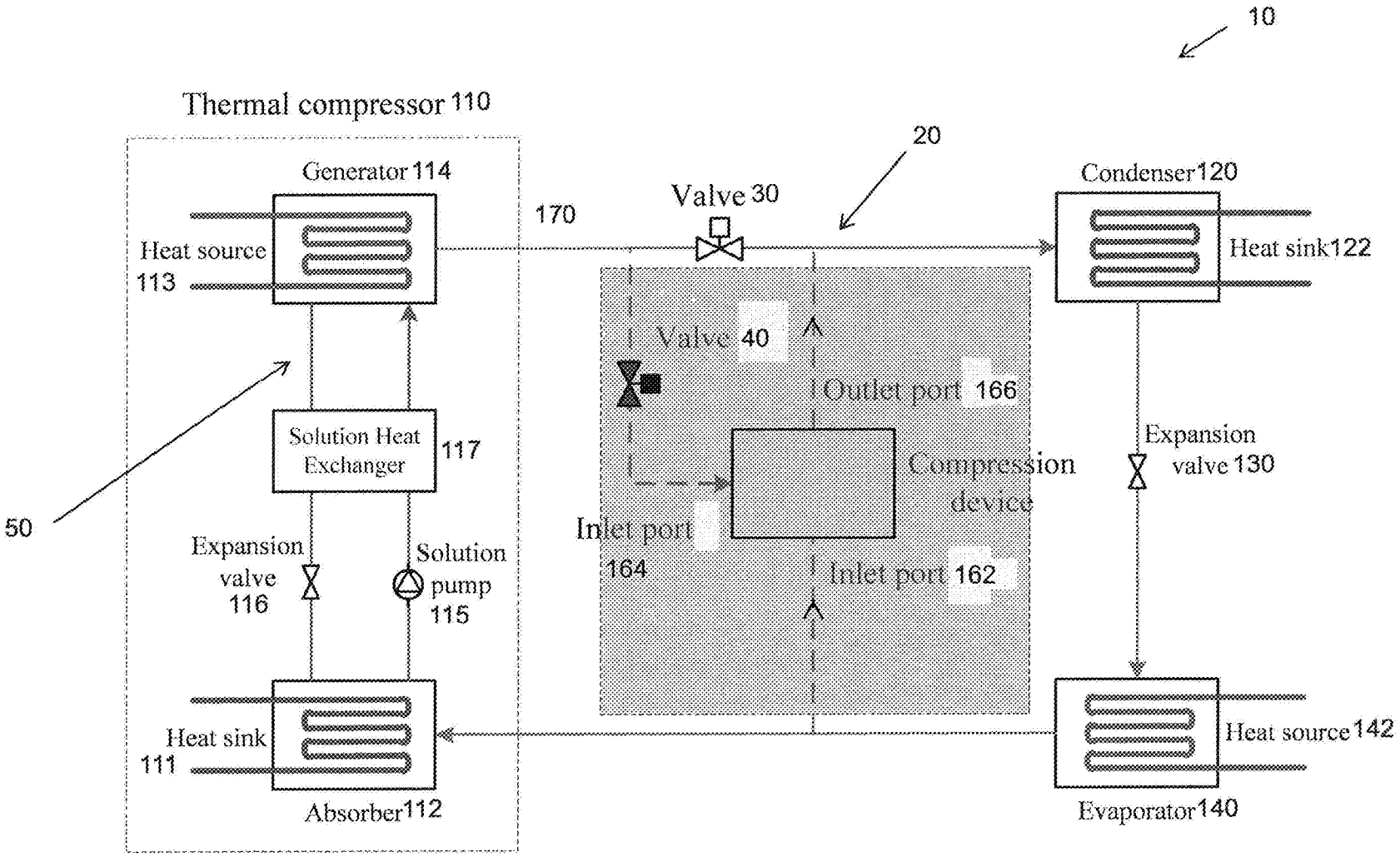
FIG. 7 is a schematic diagram of the hybrid absorption-compression heat pump of FIG. 1 operated in single absorption cycle mode.
Figure 8:
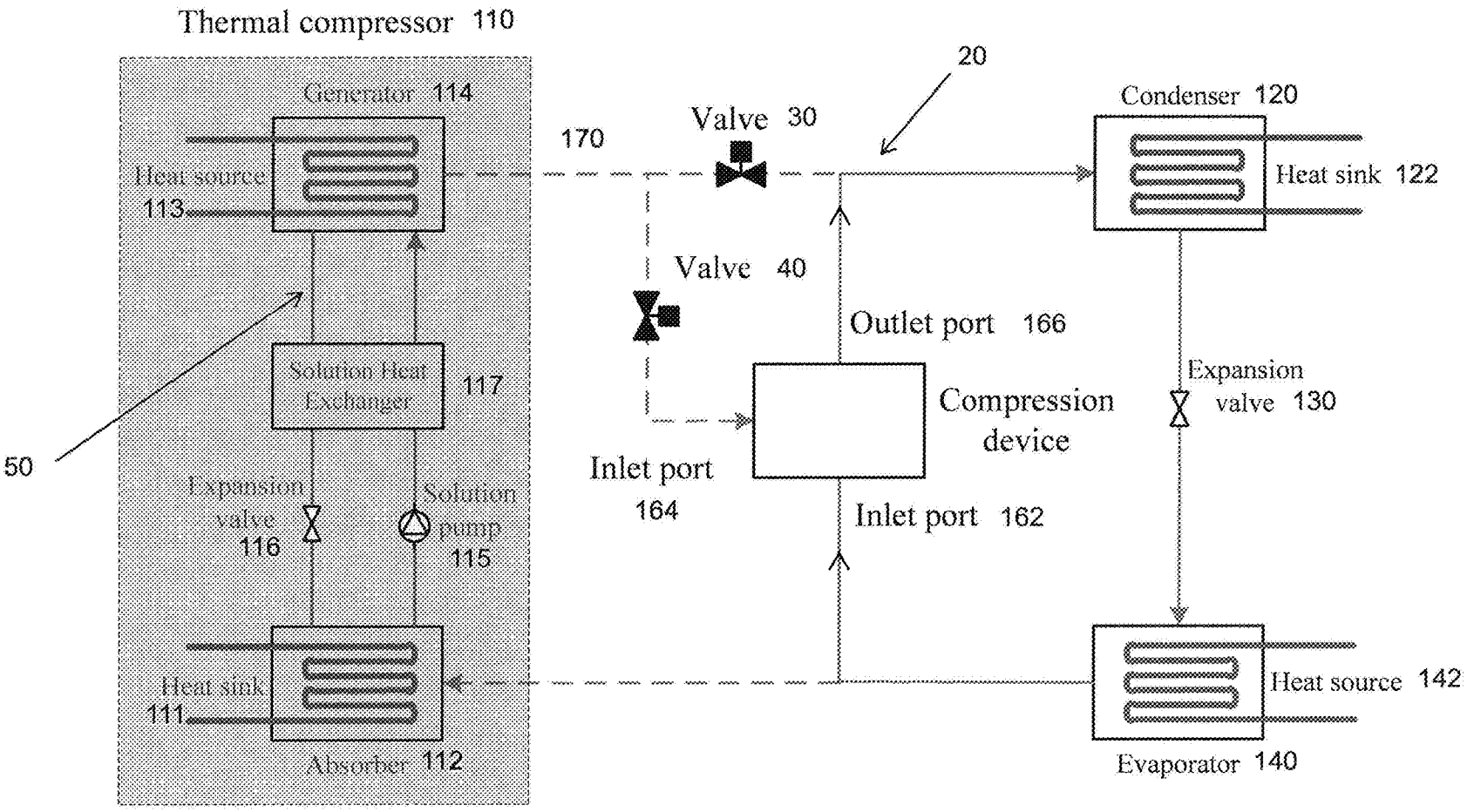
FIG. 8 is a schematic diagram of the hybrid absorption-compression heat pump of FIG. 1 operated in single compression cycle mode.

The first and second valves 30, 40 may also be operated in cooperation with the first and compression means 110 and 150 for operating the system 10 like a conventional absorption or compression cycle. Mode 3 operates as a single absorption cycle mode when the first valve 30 is open, the second valve 40 is closed, and the second compression means 150 is deactivated (as shown in FIG. 7). Mode 4 operates as a single compression cycle mode when the first valve 30 is closed, the second valve 40 is closed, and the first compression means 110 is deactivated (as shown in FIG. 8).

Figure 2:
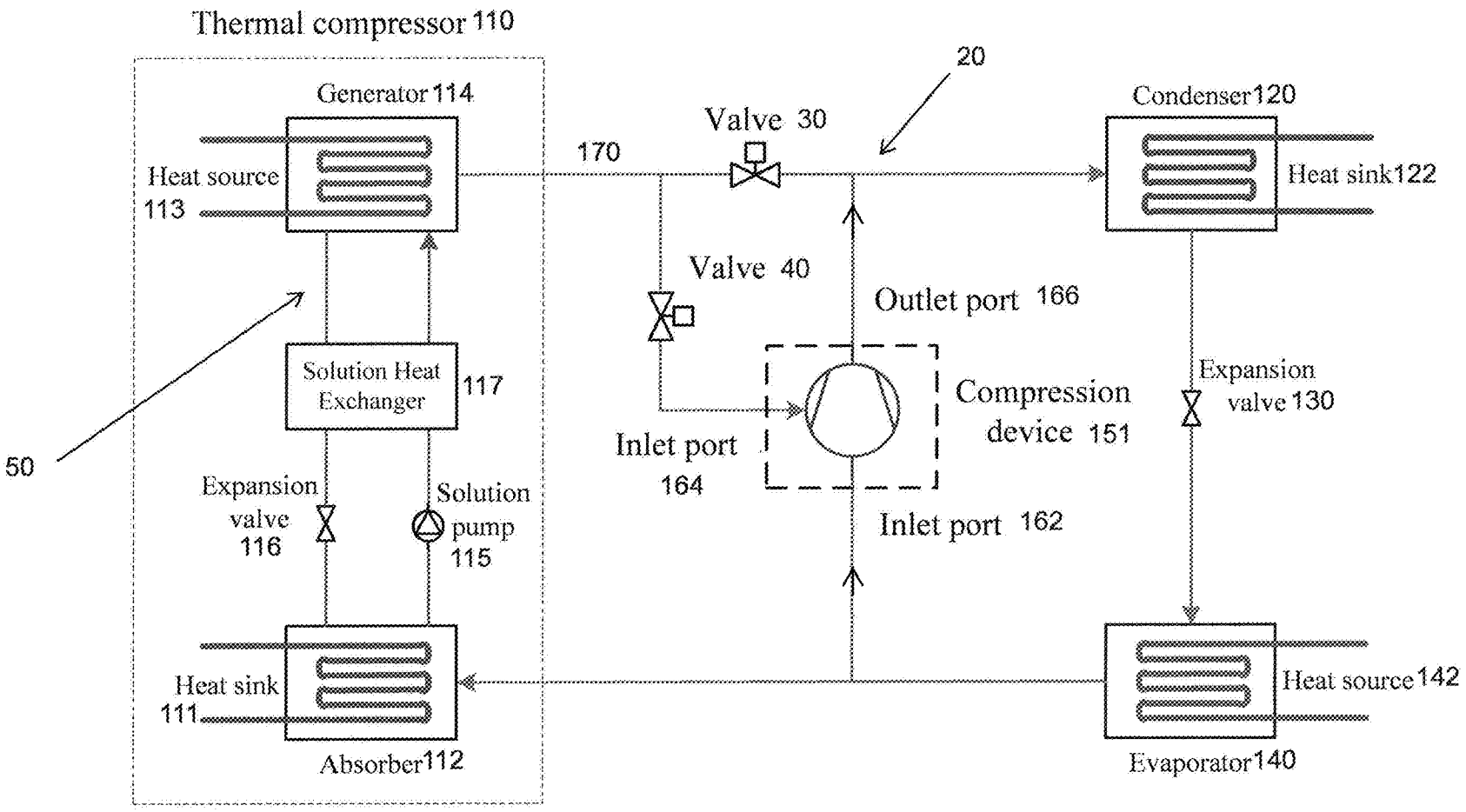
FIG. 2 is a schematic diagram of the hybrid absorption-compression heat pump of FIG. 1 with injection-type compressor.
Figure 3:
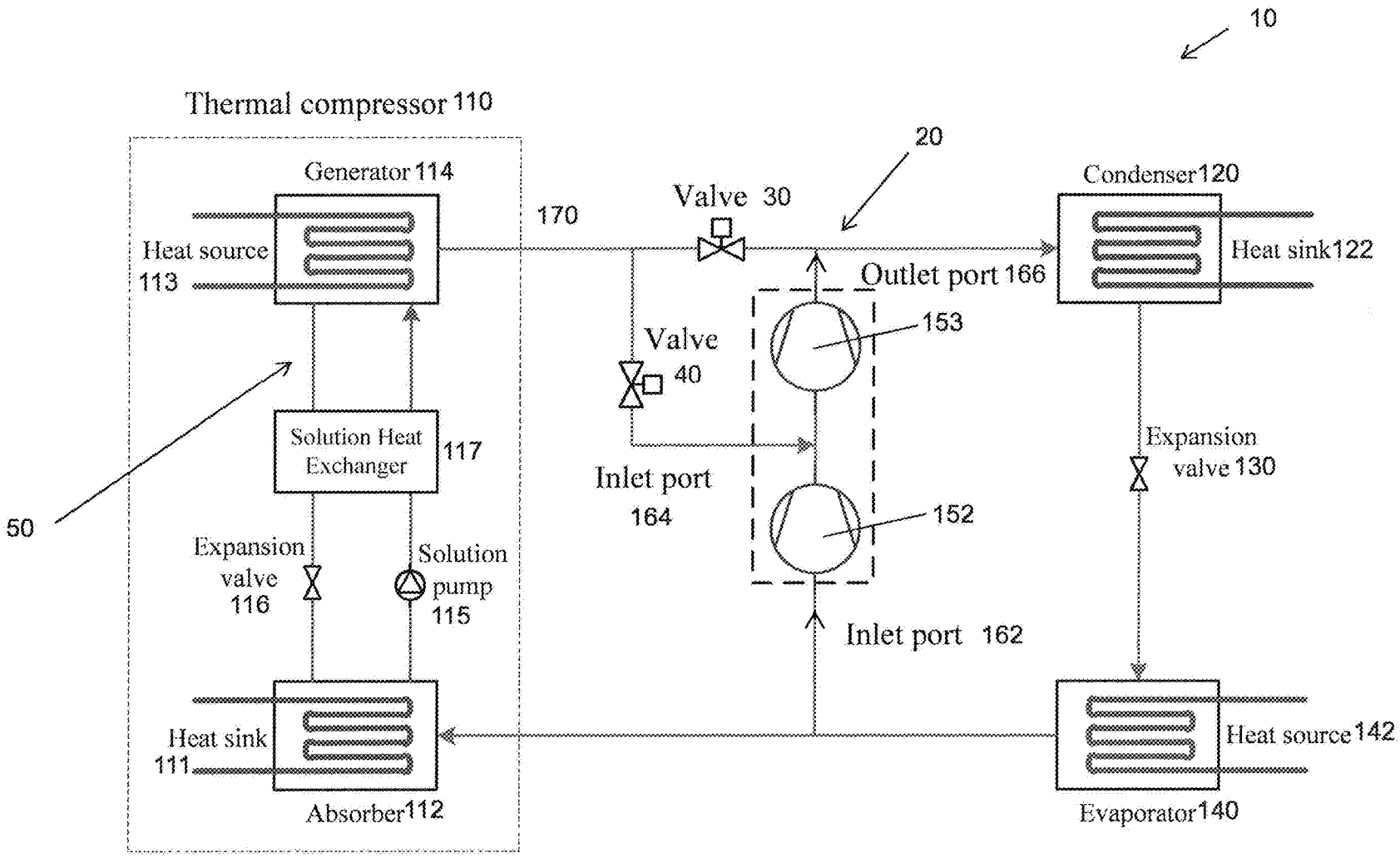
FIG. 3 is a schematic diagram of the hybrid absorption-compression heat pump of FIG. 1 with single-shell two-stage compressor or serially-connected compressors.
Figure 4:
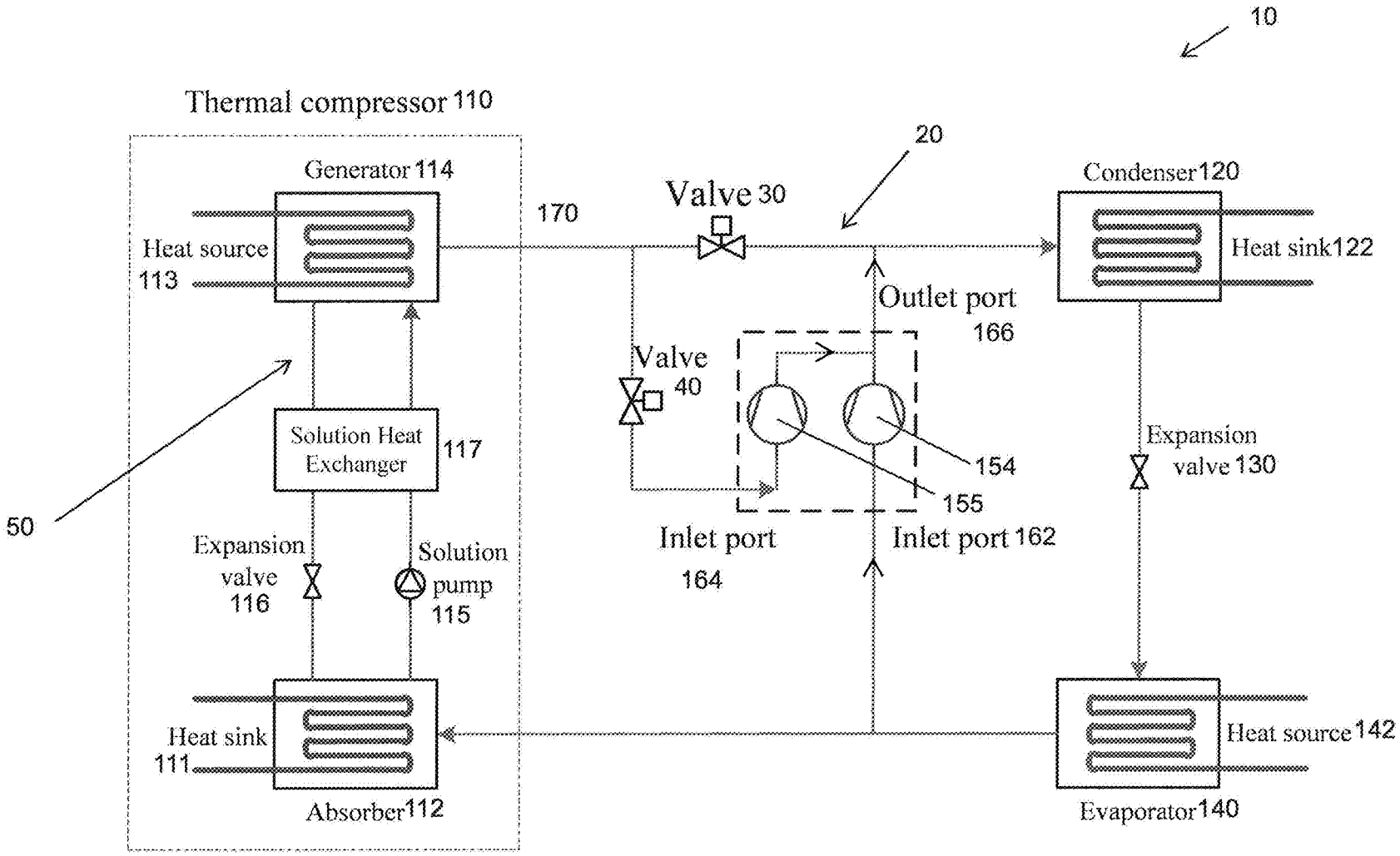
FIG. 4 is a schematic diagram of the hybrid absorption-compression heat pump of FIG. 1 with single-shell dual-cylinder compressor or parallelly-connected compressors.

Preferably, the flow path of the second compression means 150 may be modified for different compressors, such as an injection-type compressor (as shown in FIG. 2), a single-shell two-stage compressor or a single-shell dual-cylinder compressor (as shown in FIG. 3), and serially-connected compressors or parallelly-connected compressors (as shown in FIG. 4).

In one embodiment as shown in FIG. 2, the second compression means 150 may be an injection-type compressor 151 for injecting the pressurized vapor leaving the generator 114 of the first compression means 110 to the second compression means 150 through the second inlet port 164. Preferably, the injection-type compressor may be a reciprocating compressor, rolling compressor, scroll compressor, screw compressor, or centrifugal compressor.

In one embodiment as shown in FIG. 3, the second compression means 150 may include a two-stage compressor, whereby a portion of the refrigerant vapor from the evaporator means 140 is introduced to the first stage 152 of the second compression means 150 through the first inlet port 162 and the pressurized vapor leaving the generator 114 of the first compression means 110 is injected between the first stage 152 and the second stage 153 of the second compression means 150 through the second inlet port 164 subsequent to the first stage 152.

Preferably, different stages 152, 153 of the single-shell two-stage compressor may be the same type of compressor such as reciprocating compressor, rolling compressor, scroll compressor, screw compressor, or centrifugal compressor or combinations of different types of compressor.

Alternatively, the second compression means 150 may be embodied as two, first and second serially-connected compressors 152, 153, whereby a portion of the refrigerant vapor from the evaporator means 140 is introduced to the first compressor 152 of the second compression means 150 through the first inlet port 162 and the pressurized vapor leaving the generator 114 of the first compression means 110 is injected between the first compressor 152 and the second compressor 153 through the second inlet port 164. Preferably, the individual compressors 152, 153 of the serially-connected compressors may be the same type of compressor such as reciprocating compressor, rolling compressor, scroll compressor, screw compressor, or centrifugal compressor or combinations of different types of compressor.

In yet another embodiment as shown in FIG. 4, the second compression means 150 may include a dual-cylinder compressor 154, 155 for each receiving and compressing a portion of the refrigerant vapor 20 from the evaporator means 140 and the pressurized vapor from the first compression means 110 individually through the first and second inlet ports 162, 164 and for passing both to the condensing means 120 through the outlet port 166. Preferably, different cylinders 154, 155 of the single-shell dual-cylinder compressor may be the same type of compressor such as reciprocating compressor, rolling compressor, scroll compressor, screw compressor, or centrifugal compressor or combinations of different types of compressor.

Alternatively, the second compression means 150 may be embodied as two, first and second parallelly-connected compressors 154, 155 for each receiving and compressing a portion of the refrigerant vapor 20 from the evaporator means 140 and the pressurized vapor from the first compression means 110 individually through the first and second inlet ports 162, 164 and for passing both to the condensing means 120 through the outlet port 166. Preferably, the individual compressors 154, 155 of the parallelly-connected compressors may be the same type of compressor such as reciprocating compressor, rolling compressor, scroll compressor, screw compressor, or centrifugal compressor or combinations of different types of compressor.

In addition, depending on the types of compressors, the compression device 150 can be further extended. For the injection-type compressor 151, it could be reciprocating compressor, rolling compressor, scroll compressor, screw compressor, or centrifugal compressor. For the single-shell two-stage compressor or single-shell dual-cylinder compressor 152, 153, and serially-connected compressors or parallelly-connected compressors 154, 155, different stages, different cylinders or different individual compressors can be the same type of compressor such as reciprocating compressor, rolling compressor, scroll compressor, screw compressor, or centrifugal compressor or combinations of different types of compressor.

Referring now to FIG. 5 for the detailed description of the hybrid absorption-compression heat pump 10 operated in hybrid absorption-compression cycle mode with refrigerant injection. In the combined absorption-compression mode, the design proportions of the compression sub-cycle and the absorption sub-cycle can be adjusted to accommodate the supply-side capacity profiles and demand-side load profiles, to maximize primary energy efficiencies, to minimize heat pump oversizing, or to reach annual rejection-and-extraction heat balance. When the driving source temperature of heat source 113 is not high enough or the evaporating temperature is low, this mode can be activated by closing the first valve 30. The pressurized vapor leaving the generator 114 of the first compression means 110 and a portion of the vapor leaving the evaporator means 140 are received by the second compression means 150 individually through the second and first inlet ports 164, 162 and pressurized by the second compression means 150 and subsequently received through the outlet port 166 and condensed by the condensing means 120.

Referring to FIG. 6 for the detailed description of the hybrid absorption-compression heat pump 10 operated in hybrid absorption-compression cycle mode without refrigerant injection. When the driving source temperature of heat source 113 is high enough or the evaporating temperature is high, this mode can be activated by closing second valve 40. Meanwhile, the second compression means 150 is adjusted due to the closing of the second inlet port 164. A portion of the vapor leaving the evaporator means 140 is received through the first inlet port 162 and pressurized by the second compression means 150, and the pressurized vapor leaving the first and second compression means 110, 150 are subsequently received and condensed by the condensing means 120.

Referring to FIG. 7 for the detailed description of the hybrid absorption-compression heat pump 10 operated in single absorption cycle mode i.e. single absorption mode with the compression sub-cycle bypassed. This mode can be used when the electrical energy or mechanical energy is not available or not preferred. To activate this mode, the first compression means 110 is activated and the second compression means 150 is deactivated, whereby the refrigerant vapor leaving the evaporator means 140 is received by the absorber 112 of the first compression means 110 directly and subsequently received and condensed by the condensing means 120.

Referring finally to FIG. 8 for the detailed description of the hybrid absorption-compression heat pump 10 operated in single compression cycle mode i.e. single compression mode with the absorption sub-cycle bypassed. This mode can be used when the thermal energy from renewable energy source such as solar source, geothermal source, waste source, fossil fuel, etc. is not available or not preferred with the system powered by electricity from the grid or by mechanical energy from the fuel engine. To activate this mode, the first compression means 110 is deactivated and the second compression means 150 is activated, whereby the refrigerant vapor leaving the evaporator means 140 is received through the inlet port 162 and pressurized by the second compression means 150 and subsequently received through the outlet port 166 and condensed by the condensing means 120.

Overall, the invention provides a very flexible heat pump technology, which can operate at the most efficient mode depending on the actual conditions. Also, the mid-pressure refrigerant injection at the second inlet port 164 can greatly decrease the required driving temperature by strengthening the generation process with reduced generating pressure while maintaining the same condensing pressure. This is of great significance to make use of lower-temperature heat sources 113 that otherwise could not be used or had to be used with lower efficiencies. A substantially more renewable energy and waste heat can be efficiently utilized as the driving source of heat pump cycles.

The vapor-compression cycle features high cooling efficiency, high cooling-to-heating capacity ratio (heat pump tends to be oversized in cooling mode) and high extraction-to-rejection heat ratio (soil temperature decrease for ground-source applications), while the absorption cycle shows opposite features, i.e., high heating efficiency, high heating-to-cooling capacity ratio (heat pump tends to be oversized in heating mode) and high rejection-to-extraction heat ratio (soil temperature increase for ground-source applications). The hybrid absorption-compression heat pump with refrigerant injection can strengthen the advantages and cancel the disadvantages for year-round operations.

The refrigerant injection provides high-pressure compression between the generator 114 and the condenser 120 to strengthen the generation process of the absorption sub-cycle. The second inlet port 164 determines the pressure lift and can be optimized under various working conditions.

Advantageously, the pressure boosting at the high-pressure side of the absorption sub-cycle is not provided by an additional independent compressor but provided by the refrigerant-injection function of the compression device 150 of the compression sub-cycle.

This novel technology has great potentials for energy saving in a wide range of applications, including cooling, heating and drying in residential, commercial and industrial sectors.

In addition, this invention can also be used for cooling applications with lower cooling temperatures or in hotter climates, as well as for heating applications with higher heating temperatures or in colder climates.

This novel technology can be used for hybrid-energy heat pumps, photovoltaic/thermal heat pumps and gas-fired hybrid heat pumps for energy saving in cooling, heating and drying applications.

It can be well used for hybrid-energy heat pumps for peak-load shaving of the electrical power grid, for waste heat recovery from lower-temperature energy sources, for lower-temperature geothermal energy sources, for lower-temperature solar energy and thus higher solar collecting efficiency.

It can be well used for photovoltaic/thermal heat pumps to increase the overall solar energy efficiency and thus reduce the solar panel installation area.

It can also be used for gas-fired hybrid heat pumps to improve the overall energy efficiency by deep heat recovery from the exhaust flue gas.

It will be appreciated by persons skilled in the art that numerous variations and/or modifications may be made to the present invention as shown in the specific embodiments without departing from the spirit or scope of the invention as broadly described. The present embodiments are, therefore, to be considered in all respects as illustrative and not restrictive.

It will also be appreciated by persons skilled in the art that the present invention may also include further additional modifications made to the hybrid heat pump system which does not affect the overall functioning of the hybrid heat pump system.

Any reference to prior art contained herein is not to be taken as an admission that the information is common general knowledge, unless otherwise indicated. It is to be understood that, if any prior art information is referred to herein, such reference does not constitute an admission that the information forms a part of the common general knowledge in the art, any other country.

The invention claimed is:

1. A hybrid heat pump system including a thermally-driven absorption sub-cycle and an electrically-driven compression sub-cycle, the hybrid heat pump system comprising:

first compression means, operating as the thermally-driven absorption sub-cycle, operable to form a refrigerant in vapor form and increases the pressure of the refrigerant vapor;

condensing means arranged to receive the pressurized vapor and condense the vapor under pressure to a liquid;

pressure reduction means through which the liquid refrigerant leaving the condensing means passes to reduce the pressure of the liquid to form a mixture of liquid and vapor refrigerant;

evaporator means arranged to receive the mixture of liquid and vapor refrigerant that passes through the pressure reduction means to evaporate the remaining liquid to form refrigerant vapor;

second compression means, operating as the electrically-driven compression sub-cycle, including a single injection-type compressor having a first inlet port and a second inlet port and an outlet port wherein the injection-type compressor is operable to inject the pressurized vapor leaving the first compression means to the second compression means by:

receiving at least a portion of the refrigerant vapor from the evaporator means and the pressurized vapor from the first compression means through the first and second inlet ports respectively;

increasing the pressure thereof; and passing the pressurized vapor to the condensing means through the outlet port; and a conduit operable to pass a portion of the refrigerant vapor leaving the first compression means to the second compression means.

2. The system of claim 1, wherein the injection-type compressor includes a two-stage compressor, whereby a portion of the refrigerant vapor from the evaporator means is introduced to a first stage of the second compression means and the pressurized vapor leaving the first compression means is injected between the first stage and a second stage of the second compression means subsequent to the first stage.

3. The system of claim 1, wherein the injection-type compressor includes a first compressor and a second compressor, whereby a portion of the refrigerant vapor from the evaporator means is introduced to the first compressor and the pressurized vapor leaving the first compression means is injected between the first compressor and the second compressor, and wherein the first and the second compressors are connected in series.

4. The system of claim 1, wherein the injection-type compressor a dual-cylinder compressor for each receiving and compressing a portion of the refrigerant vapor from the evaporator means and the pressurized vapor from the first compression means individually and for passing both to the condensing means.

5. The system of claim 1, wherein the injection-type compressor includes a first compressor and a second compressor for each receiving and compressing a portion of the refrigerant vapor from the evaporator means and the pressurized vapor from the first compression means individually and for passing both to the condensing means, and wherein the first and the second compressors are connected in parallel.

6. The system of claim 1, wherein the first compression means further includes:

an absorber that forms a mixture of a refrigerant and an absorbent; and a generator that receives the mixture from the absorber and heats the mixture to separate refrigerant, in vapor form, from the absorbent.

7. The system of claim 6, wherein the pressure of the refrigerant vapor from the generator is increased by the second compression means.

8. The system of claim 1, wherein the pressure at the outlet port is higher than that at the first and second inlet ports, and the pressure at the second inlet port is controlled to be higher than that at the first inlet port by manipulating one or more valves in fluid communication with the first inlet port and/or the second inlet port.

9. The system of claim 8, wherein the fluid communication between the first compression means and the condensing means is manipulated by a first valve and the fluid communication between the first and second compression means is manipulated by a second valve.

10. The system of claim 1, wherein the pressurized vapor leaving the first compression means and a portion of the vapor leaving the evaporator means are received by the second compression means individually and pressurized by the second compression means and subsequently received and condensed by the condensing means.

11. The system of claim 1, wherein a portion of the vapor leaving the evaporator means is received and pressurized by the second compression means, and the pressurized vapor leaving the first and second compression means are subsequently received and condensed by the condensing means.

12. The system of claim 1, wherein the first compression means is activated and the second compression means is deactivated, whereby the refrigerant vapor leaving the evaporator means is received by the first compression means and subsequently received and condensed by the condensing means.

13. The system of claim 1, wherein the first compression means is deactivated and the second compression means is activated, whereby the refrigerant vapor leaving the evaporator means is received and pressurized by the second compression means and subsequently received and condensed by the condensing means.

14. The system of claim 1, wherein the injection-type compressor includes at least one of reciprocating compressor, rolling compressor, scroll compressor, screw compressor, and centrifugal compressor.

* * * * *